United States Patent [19]

Endoh

[11] 4,441,901

[45] Apr. 10, 1984

[54] HEAT PUMP TYPE AIRCONDITIONER

[75] Inventor: Masakazu Endoh, Osaka, Japan

[73] Assignee: Mitsubishi Denki Kabushiki Kaisha, Tokyo, Japan

[21] Appl. No.: 379,988

[22] Filed: May 19, 1982

[30] Foreign Application Priority Data

Jun. 5, 1981 [JP] Japan ..... 56-86682

[51] Int. Cl.[3] ..... F25B 13/00; F25B 27/00; F25B 29/00

[52] U.S. Cl. ..... 62/160; 62/181; 62/196.3; 62/238.7; 165/29

[58] Field of Search ..... 62/160, 196.3, 324.6, 62/238.6, 238.7, 183, 181; 165/29

[56] References Cited

U.S. PATENT DOCUMENTS

| | | | |
|---|---|---|---|
| 3,514,967 | 6/1970 | Van der Molen | 62/181 |
| 3,563,394 | 2/1971 | McGrath . | |
| 3,627,031 | 12/1971 | Ware . | |
| 3,777,508 | 12/1973 | Imabayashi et al. . | |
| 3,918,268 | 11/1975 | Nussbaum | 62/160 |
| 4,065,938 | 1/1978 | Jonsson | 62/160 |
| 4,179,894 | 12/1979 | Hughes | 62/160 |
| 4,364,237 | 12/1982 | Cooper et al. | 62/181 |

*Primary Examiner*—Henry C. Yuen
*Assistant Examiner*—Harry Tanner
*Attorney, Agent, or Firm*—Wenderoth, Lind & Ponack

[57] ABSTRACT

A heat pump type airconditioner wherein a heat exchanger serving as a vaporizer during a warming operation mode is heated by a heating means such as combustion gas from a burner, so as to heat the refrigerant before flowing through the heat exchanger before it is compressed, in which a bypass bypasses part of the refrigerant delivered from the compressor back to the suction side of the compressor during the refrigerant heating operation, and a temperature sensor is disposed in the refrigerant outlet pipe line from the heat exchanger serving as the vaporizer in the refrigerant heating operation and controlling the turning "on" and "off" of the combustion in order to keep the degree of superheat of the refrigerant lower than the deterioration temperature of the refrigerant as well as the refrigerating machine oil and a temperature controller adjacent the indoor heat exchanger and which controls the air flow rate over the indoor heat exchanger in dependence on the temperature of the air stream.

19 Claims, 1 Drawing Figure

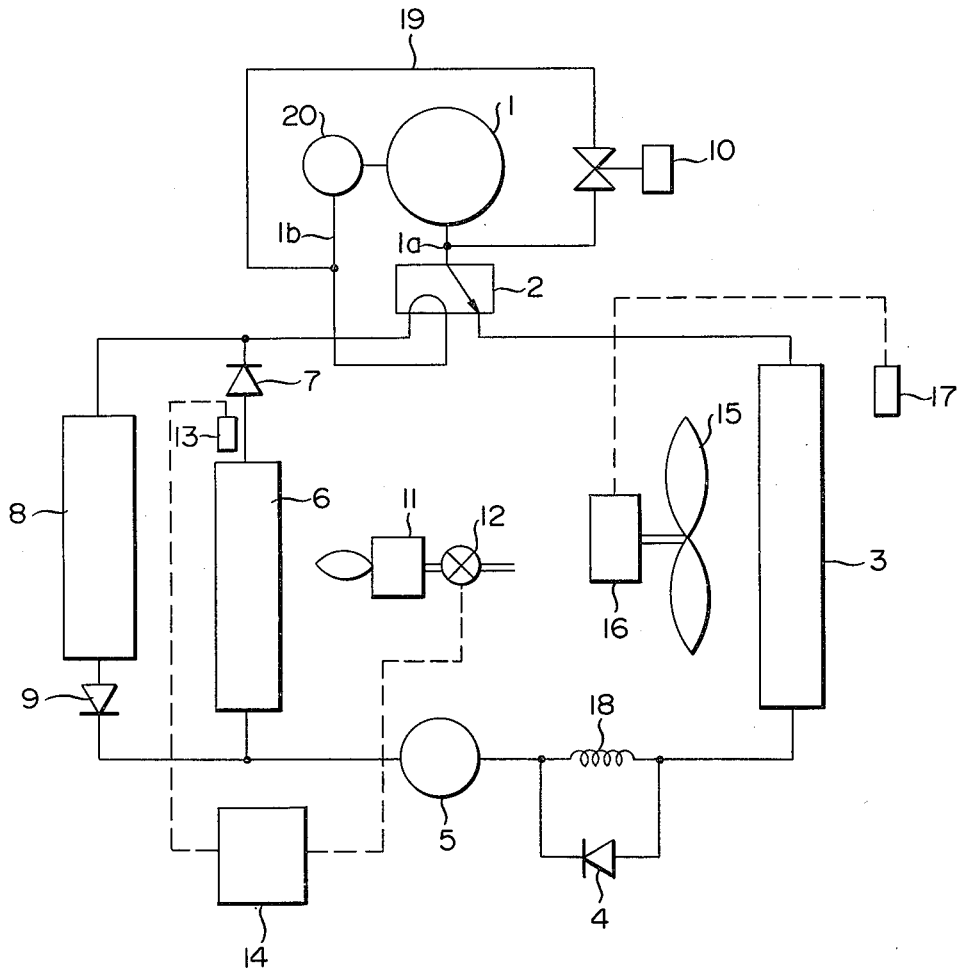
19
20
1
10
1b
1a
2
7
17
13
15
8
6
11
12
3
16
9
18
5
4
14

HEAT PUMP TYPE AIRCONDITIONER

BACKGROUND OF THE INVENTION

The present invention relates to a heat pump type airconditioner which heats a refrigerant with a heat source other than the atmospheric air.

Heretofore, heating apparatuses based on the heat pump cycle have been proposed. Since, however, they employ the atmospheric air as the heat source for the heat pump, a sufficient quantity of heat is not obtained when the temperature of the open air falls in winter or in a cold district. Accordingly, they have the disadvantages that the warming capability is reduced and that the rise to meet the temperature of a warming load is inferior. Further, if the temperature of the refrigerant flowing into the heat-source-side heat exchanger is lowered to increase the quantity of heat which can be absorbed from the atmospheric air, there is the disadvantage that the heat exchanger frosts over, so the heat exchange capability decreases. As an expedient for compensating for the insufficient capability of the heat pump cycle, there is a method in which an electric heater is provided as an auxiliary heat source and disposed in the vicinity of a heat exchanger functioning as a condenser in a warming operation. Such airconditioners, however, have the disadvantages:

(a) that since the capacity of the heater is small relative to the warming load, the heater is sometimes insufficient for the auxiliary heating during warming and has a limited range of use, (b) that the heater costs more to operate as compared with other heat sources and places many limitations on the airconditioner, such as the requirement for installation of a power supply for the heater, etc.

In order to eliminate the disadvantages of the prior art devices described above, an airconditioner has been proposed in U.S. patent application Ser. No. 362,838 by Nomaguchi et al, assigned to Mitsubishi Denki Kabushiki-Kaisha (corresponding to Japanese Patent Application No. 55-137408). The present invention relates in improvements made from a viewpoint different from that of the aforementioned pending application.

SUMMARY OF THE INVENTION

The present invention has for its object to provide an airconditioner in which heat is supplied by a burner, thereby making it possible to increase the warming capability and to dispense with a defrosting operation; the heat transmission area of a heat-source-side heat exchanger is reduced so that the size of the unit can be kept small and the power of the compressor required during the supply of the combustion heat is reduced to prevent the energy efficiency of the system from being reduced.

Another object of the present invention is to provide an airconditioner wherein a heat exchanger serving as a vaporizer during a warming operation mode is heated by a heating source such as combustion gas, so as to heat the refrigerant flowing through the heat exchanger before it is compressed.

The airconditioner according to the invention is characterized by comprising a bypass which conducts part of the refrigerant delivered from a compressor back to the suction side of the compressor during the refrigerant heating operation, a solenoid valve which closes said bypass during a cooling operation mode, a heat exchanger functioning as a condenser during the cooling operation mode and a heat exchanger functioning as the vaporizer in the warming operation mode separately disposed, check valves which permit the selective use of the respective heat exchangers during the cooling operation mode and the warming operation mode, a reservoir which is inserted in a pipe line where the refrigerant becomes the liquid phase during the cooling operation mode and in which the excessive refrigerant is stored during the cooling operation mode, a temperature swich which is disposed at the refrigerant outlet pipe line part of the heat exchanger serving as the vaporizer during the refrigerant heating operation, for turning the combustion "on" and "off" in order to make the degree of superheat of the refrigerant lower than the deterioration temperature of the refrigerant as well as the refrigerating machine oil at the time of the refrigerant heating operation by the combustion gas during the warming operation mode, a heat exchanger which functions as a condenser in the warming operation mode and which radiates heat by performing heat exchange with the air owing to an air stream caused to flow thereover by a blower, and a temperature controller which is disposed adjacent the last-mentioned heat exchanger and which changes the air flow rate of the air stream in dependence on the temperature of the air stream.

BRIEF DESCRIPTION OF THE DRAWING

The single FIGURE is a schematic view showing an embodiment of the refrigerant circuit of a heat pump type airconditioner according to the present invention.

DETAILED DESCRIPTION OF THE PREFERRED EMBODIMENT

An embodiment of the present invention now be described with reference to the drawing. In the single FIGURE, a four-way valve 2 for changing-over a refrigerant circuit as is connected on the delivery side 1*a* and suction side 1*b* of a compressor 1 reverses the flow of a refrigerant during cooling and warming operation modes. An indoor heat exchanger 3 which serves as a condenser during the warming operation mode functions as a vaporizer during the cooling operation mode. A pressure reduction mechanism 18 for the cooling operation mode is constructed of a capillary tube, and a check valve 4 for bypassing this mechanism during the warming operation mode is connected in parallel therewith. Numeral 5 indicates a reservoir for receiving the refrigerant during the cooling. A third heat exchanger 6 is an endothermic heat exchanger which absorbs heat from a combustion heat source and vaporizes the refrigerant during the warming operation mode. Third valve means 7 is a check valve which prevents the refrigerant from flowing into the endothermic heat exchanger 6 and then circulating during the cooling operation mode. A second heat exchanger 8 is an outdoor heat exchanger which functions as a condenser during the cooling operation mode. Second valve means 9 is a check valve which prevents the refrigerant from flowing into the heat exchanger 8 during the warming operation mode. A solenoid valve 10 and a bypass 19 bring part of the refrigerant delivered from the compressor 1, back to the suction side 1*b* of the compressor 1 during the warming operation mode because the circulation rate of the refrigerant through the heat exchangers would otherwise be too large. The solenoid valve 10 is disposed midway of the bypass 19. Numeral 11 indicates heating means which operates during the warming operation mode. It is constructed of a burner, such as an oil burner, for heating the refrigerant, and the combustion gas of the burner is directly applied to the endothermic heat exchanger 6. Designated by numeral 12 is a switch, such as a solenoid valve, which turns the burner ON and OFF and which is controlled by a controller 14. A temperature sensor such as thermistor 13 is mounted on the outer peripheral surface of the outlet refrigerant pipe of the heat exchanger 6, and senses the temperature of the refrigerant in order to execute the switching operation of the solenoid valve 12 or the like. The controller 14 actuates the solenoid valve 12 on the basis of the information from the sensor, for example, a temperature-dependent resistance. Blowing means 15 is constructed of a propeller fan, a line flow fan or the like, and functions to blow the air from the room being heated over the indoor heat exchanger 3 to draw heat from the heat exchanger 3 which operates as a condenser during the warming operation mode. A temperature sensor 17 is provided which can be a thermistor or the like. It is an air temperature sensor which serves to control the flow rate of the air from the blow 15 by control of the blow motor 16 depending upon the temperature of the refrigerant passing through the indoor heat exchanger 3. Numeral 20 designates an accumulator.

There will now be described the operations of this airconditioner constructed as described above.

In the warming operation mode, owing to the operation of the compressor 1, the refrigerant enters the refrigerant heating heat exchanger 6 through the four-way valve 2, the condensation side heat exchanger 3, the check valve 4 and the reservoir 5. At this time, the adiabatic expansion of the refrigerant is caused by a slight resistance of the path extending from the four-way valve 2 to the reservoir 5. When the refrigerant flows through the heat exchanger 6, it picks up heat from the heating source and is vaporized here. At the outlet of the heat exchanger 6, the refrigerant is already in the form of superheated vapor. The superheated vapor having a high degree of superheat is drawn into the compressor 1 by suction through the four-way valve 2, and is subjected to adiabatic compression to become refrigerant vapor the temperature of which is even higher than the incoming refrigerant temperature and which is fed under pressure to the condensing heat exchanger 3.

Here, in the refrigerant circuit according to the present invention, no pressure reduction mechanism is included between the condensation side heat exchanger 3 and the refrigerant heating heat exchanger 6, so that the effect of the adiabatic expansion is low. Therefore, the compression ratio is small, and the refrigerant temperature at the outlet of the compressor 1 becomes equal to or higher than the temperature of the refrigerant drawn into the compressor in the prior-art system. In other words, since the temperature rise may be small, the degree of superheat can be set high. Further, the vaporization pressure can be set high because of the heat supply from the heating source 11, and it is slightly different from the condensation pressure. Accordingly, the compression ratio is small, and the amount of work needed for compression is smaller than in the heat pump in the prior art.

On account of the small compression ratio and the high vaporization pressure, however, the quantity of the refrigerant which the compressor 1 takes in increases, and the circulation rate thereof increases. When the delivery rate of the compressor 1 is viewed on the assumption that the warming capability is fixed, the following holds:

$$R = \frac{\mu_v - q}{v} V = K \cdot \frac{V}{v}$$

R: warming capability,
$\mu_v$: volume efficiency of the compressor,
q: warming effect (enthalpy difference),
v: specific volume,
V: delivery rate of the compressor.

When $\mu_v$ and q are deemed coefficients in the above expression, v decreases with a rise of the vaporization pressure. Therefore, in the case where R is constant, V needs to be proportionally reduced.

In order to establish the balance between the increase of the delivery rate and the required circulation rate, the present invention provides the bypass 19 from the delivery side of the suction side of the compressor 1 so as to conduct part of the delivered refrigerant from the delivery side back to the suction side. Since the bypass 19 is unnecessary during the cooling operation mode, the solenoid valve 10 is provided and is closed during the cooling operation.

The refrigerant formed into the superheated vapor by the endothermic heat exchanger 6 is partly fed to the heat exchanger 8 when fed to the four-way valve 2 via the check valve 7. Here, when wind or rain impinges on the heat exchanger 8, the superheated refrigerant is condensed again. In some cases, the condensed refrigerant entirely fills the heat exchanger in the liquid phase. In the present invention, therefore, the refrigerant is positively stored within the heat exchanger 8, and this heat exchanger is filled up with refrigerant entirely in the liquid phase. Thus, fluctuations in the circulation rate of the refrigerant or fluctuations in the warming capability attributed to wind and rain are eliminated. In the cooling mode, naturally the refrigerant in the states of from the superheated vapor to supercooled refrigerant flows through the heat exchanger 8, and the aforementioned liquid-phase refrigerant needs to be stored in the reservoir 5. The reservoir 5 is disposed at the outlet of the heat exchanger 8 so as to receive the liquid-phase refrigerant during the cooling operation mode. Further, since the check valve 7 is disposed on the outlet side of the endothermic heat exchanger 6, this heat exchanger also functions as a reservoir during the cooling operation mode.

As set forth above, the present invention separately uses the condenser heat exchanger 8 during the cooling operation mode and the vaporizer heat exchanger 6 during the warming operation mode, unlike the prior-art heat pump type airconditioner, and it accordingly provides the check valves 7 and 9 for selectively connecting the heat exchangers 6 and 8 in the refrigerating circuit.

In the present invention, in case the temperature of the outside air is low during the warming operation mode, the circulation rate of the refrigerant flowing through the endothermic heat exchanger 6 to absorb the supplied heat is small relative to the rate of heat supply due to the operation of the heating source 11 at the time of the starting of the warming, and hence, the refrigerant temperature at the outlet of the heat exchanger 6 exceeds the thermal deterioration temperature (for example, $t_1 = 240°$ F.) of the refrigerant as well as refrigerating machine oil. Accordingly, the temperature sensor 13 is disposed at the outlet of the heat exchanger 6 so as to sense the outlet temperature. When there is an excessive rise, the operation of the heating source 11 is stopped through the known controller 14 constructed of an amplifier, a comparator etc. Further, the refrigerant having become superheated vapor and delivered from the compressor 1 is condensed and liquified in the condensing heat exchanger 3 at the starting of the warming. In this ragard, when the rate of the air flow from the blower 15 is large and the heat exchange efficiency is high, the condensation becomes excessive and the inflow of the refrigerant to the endothermic heat exchanger 6 decreases, so that the outlet refrigerant temperature of the heat exchanger 6 rises excessively and the number of times the heating source turns on and off increases, resulting in the disadvantage of a slow rise of the temperature during the warming operation. Accordingly, the air flow of the blower is controlled through the sensor 17 in dependence on the temperature of the air which has passed over the condensing heat exchanger 3, so as to decrease at low temperatures of e.g., $t_2=41°$ F. or below and to increase at high temperatures of, e.g., $t_3=113°$ F. or above.

In the present invention described above, the vaporization pressure is raised by the refrigerant heating in the warming mode, so that the difference between the higher and lower pressures becomes small and the power required for the compressor decreases. Since the heat is absorbed from the heating source, the warming efficiency is constant without being affected by the temperature of the outdoor air (the temperature of the air heat source in the heat pump). In addition, the defrosting operation becomes unnecessary.

What is claimed is:

1. A heat pump type airconditioner operable in a cooling operation mode, and a warming operation mode employing a refrigerant heated with a heat generation means as a heat source, comprising: compression means to compress the refrigerant, a first heat exchanger which is disposed indoors and which functions as a vaporizer in the cooling operation mode and as a condenser in the warming operation mode, a second heat exchanger which is disposed outdoors and which functions as a condenser in the cooling operation mode, a third heat exchanger which is disposed in parallel with said second heat exchanger and which heats the refrigerant in the warming operation mode, the heat generation means applying heat to said third heat exchanger, a reservoir which stores the excess refrigerant in a pipe line where the refrigerant is in the liquid phase in the cooling operation mode, a pressure reduction mechanism which is disposed between said reservoir and said first heat exchanger and which reduces the pressure of the refrigerant circulating in the cooling operation mode, bypass means around said pressure reduction mechanism to bypass the refrigerant tending to flow to said pressure reduction mechanism in the warming operation mode, first valve means disposed at one end of said second heat exchanger on the reservoir side and functioning so as to cause liquid refrigerant to be stored in said second heat exchanger in the warming operation mode, second valve means disposed at one end of said third heat exchanger on the compression means side and functioning so as to prevent the refrigerant from flowing through said third heat exchanger in the cooling operation mode, first temperature detection means adjacent the refrigerant outlet of said third heat exchanger to sense the temperature of the refrigerant heated in said third heat exchanger in the warming operation mode, blowing means disposed in correspondence with said first heat exchanger and blowing cold air and warm air from said first heat exchanger into a room in the cooling and warming operation modes respectively, second temperature detection means adjacent said first heat exchanger to sense the temperature of the air blown over said first heat exchanger in the warming operation mode, and control means connected to the respective temperature detection means to stop operation of said heat generation means in the warming operation mode when the refrigerant temperature detected by said first temperature detection means has exceeded a predetermined value and also to regulate a rate of flow of the air from said blowing means in dependence on the air temperature detected by said second temperature detection means.

2. A heat pump type airconditioner according to claim 1, wherein said heat generation means is a burner.

3. A heat pump type airconditioner according to claim 1, wherein said third heat exchanger is a type of heat exchanger which exchanges heat directly with a combustion gas.

4. A heat pump type airconditioner according to claim 1, wherein said predetermined value of the temperature at which said forced heat generation means is stopped is no higher than the deterioration temperature of said refrigerant as well as a refrigerating machine oil.

5. A heat pump type airconditioner according to claim 1, wherein said control means comprises means for regulating the rate of flow of the air from said blowing means so as to be small at low temperatures and large at high temperatures.

6. A heat pump type airconditioner operable in a cooling operation mode, and a warming operation mode employing a refrigerant heated with a heat generation means as a heat source, comprising: a compressor which compresses the refrigerant, a first heat exchanger with is disposed indoors and which functions as a vaporizer in the cooling operation mode and as a condenser in the warming operation mode, a second heat exchanger which is disposed outdoors and which functions as a condenser in the cooling operation mode, a third heat exchanger which is disposed in parallel with said second heat exchanger and which heats the refrigerant in the warming operation mode, a burner constituting the heat generation means which supplies heat to said third heat exchanger, the combustion gas from which is directly applied to said third heat exchanger, a reservoir which stores the excess refrigerant in a pipe line where the refrigerant is in the liquid phase in the cooling operation mode, a pressure reduction mechanism which is disposed between said reservoir and said first heat exchanger and which reduces the pressure of the refrigerant circulating in the cooling operation mode, around said pressure reduction mechanism to bypass the refrigerant tending to flow to said pressure reduction mechanism in the warming operation mode, first valve means disposed at one end of said second heat exchanger on the reservoir side and functioning so as to cause the liquid refrigerant to be stored in said second heat exchanger in the warming operation mode, second valve means disposed at one end of said third heat exchanger on the compressor side and functioning so as to prevent the refrigerant from flowing through said third heat exchanger in the cooling operation mode, first temperature detection means adjacent the refrigerant outlet of said third heat exchanger to sense the temperature of the refrigerant heated in said third heat exchanger in the warming operation mode, blowing means disposed in correspondence with said first heat exchanger and blowing cold air and warm air from said first heat exchanger into a room in the cooling and warming operation modes respectively, second temperature detection means adjacent said first heat exchanger to sense the temperature of the air blown over said first heat exchanger in the warming operation mode, and control means connected to the respective temperature detection means to stop operation of said burner in the warming operation mode when the refrigerant temperature detected by said first temperature detection means has exceeded a predetermined value and also to regulate the rate of flow of the air from said blowing means in dependence on the air temperature detected by said second temperature detection means.

7. A heat pump type airconditioner according to claim 6, further comprising a changeover valve which is connected to the delivery pipe and the suction pipe of said compressor and which reverses the flow of the refrigerant in the cooling and warming operation modes.

8. A heat pump type airconditioner according to claim 6, further comprising means for bypassing part of the refrigerant delivered from said compressor back to the suction side of said compressor in the warming operation mode.

9. A heat pump type airconditioner according to claim 6, wherein said bypass means and said first and second valve means are check valves.

10. A heat pump type airconditioner according to claim 6, wherein said predetermined value of the temperature at which said burner is stopped is no higher than the deterioration temperature of said refrigerant as well as a refrigerating machine oil.

11. A heat pump type airconditioner according to claim 6, wherein said control means comprises means for regulating the rate of flow of the air from said blowing means so as to be small at low temperatures and large at high temperatures.

12. A heat pump type airconditioner operable in a cooling operation mode, and a warming operation mode employing a refrigerant heated with a heat generation means as a heat source, comprising: a compressor which compresses the refrigerant, a changeover valve which is connected to the delivery pipe and the suction pipe of said compressor and which reverses the flow of the refrigerant in the cooling and warming operation modes, a first heat exchanger which is disposed indoors and which functions as a vaporizer in the cooling operation mode and as a condenser in the warming operation mode, a second heat exchanger which is disposed outdoors and which functions as a condenser in the cooling operation mode, a third heat exchanger which is disposed in parallel with said second heat exchanger and which heats the refrigerant in the warming operation mode, a burner constituting the heat generation means which supplies heat to said third heat exchanger the combustion gas from which is directly applied to said third heat exchanger, a reservoir which stores the excess refrigerant in a pipe line where the refrigerant is in the liquid phase in the cooling operation mode, a pressure reduction mechanism which is disposed between said reservoir and said first heat exchanger and which reduces the pressure of the refrigerant circulating in the cooling operation mode, a check valve which is disposed in parallel with said pressure reduction mechanism and which bypasses the refrigerant flowing toward said pressure reduction mechanism in the warming operation mode, first valve means disposed at one end of said second heat exchanger on the reservoir side and functioning so as to cause the liquid refrigerant to be stored in said second heat exchanger in the warming operation mode, second valve means disposed at one end of said third heat exchanger on the compressor side and functioning so as to cause the liquid refrigerant to be stored in said third heat exchanger in the cooling operation mode, first temperature detection means adjacent the refrigerant outlet of said third heat exchanger to sense the temperature of the refrigerant heated in said third heat exchanger in the warming operation mode, blowing means disposed in correspondence with said first heat exchanger and blowing cold air and warm air from said first heat exchanger into a room in the cooling and warming operation modes respectively, second temperature detection means adjacent the first heat exchanger to sense the temperature of the air blown over said first heat exchanger in the warming operation mode, and control means connected to the respective temperature detection means to stop operation of said burner in the warming operation mode when the refrigerant temperature detected by said first temperature detection means has exceeded a predetermined value and also to regulate the rate of flow of the air from said blowing means in dependence on the air temperature detected by said second temperature detection means.

13. A heat pump type airconditioner according to claim 12, wherein said first temperature detection means is disposed in a refrigerant pipe line between said third heat exchanger and said second valve means.

14. A heat pump type airconditioner according to claim 13, wherein said first detection means is a thermistor sensor and is mounted on an outer peripheral part of the corresponding refrigerant pipe.

15. A heat pump type airconditioner according to claim 12, wherein said predetermined value of the temperature at which said burner is stopped is no higher than the deterioration temperature of said refrigerant as well as a refrigerating machine oil.

16. A heat pump type airconditioner according to claim 12, wherein said control means comprises means for regulating its rate of flow of the air from said blowing means at starting of the warming operation mode.

17. A heat pump type airconditioner according to claim 16, wherein said control means comprises means for regulating the rate of flow of air from said blowing means so as to be small at low temperatures and large at high temperatures.

18. A heat pump type airconditioner operable in a cooling operation mode, and a warming operation mode employing a refrigerant heated with a heat generation means as a heat source, comprising: a compressor which compresses the refrigerant, a changeover valve which is connected to the delivery pipe and the suction pipe of said compressor and which reverses the flow of the refrigerant in the cooling and warming operation modes, and indoor heat exchanger which is disposed indoors and which functions as a vaporizer in the cooling operation mode and as a condenser in the warming operation mode, an outdoor heat exchanger which is disposed outdoors and which functions as a condenser in the cooling operation mode, an endothermic heat exchanger which is disposed in parallel with said outdoor heat exchanger and which heats the refrigerant in the warming operation mode, a burner constituting the heat generation means which supplies heat to said endothermic heat exchanger the combustion gas from which is directly applied to said endothermic heat exchanger, a reservoir which stores the excess refrigerant in a pipe line where the refrigerant is in the liquid phase in the cooling operation mode, a pressure reduction mechanism which is disposed between said reservoir and said indoor heat exchanger and which reduces the pressure of the refrigerant circulating in the cooling operation mode, a first check valve which is disposed in parallel with said pressure reduction mechanism and which bypasses the refrigerant flowing toward said pressure reduction mechanism in the warming operation mode, a second check valve which is disposed at one end of said outdoor heat exchanger on the reservoir side and which functions so as to cause the liquid refrigerant to be stored in said outdoor heat exchanger in the warming operation mode, a third check valve which is disposed at one end of said endothermic heat exchanger on the compressor side and which functions so as to cause the liquid refrigerant to be stored in the endothermic heat exchanger in the cooling operation mode a first temperature sensor which senses the temperature of the refrigerant heated by said endothermic heat exchanger in the warming operation mode and which is mounted on the outer periphery of a refrigerant pipe located between said third check valve and said endothermic heat exchanger, a blower which is disposed in correspondence with said indoor heat exchanger and which blows cold air and warm air from said indoor heat exchanger into a room in the cooling and warming operation modes respectively, a second temperature sensor adjacent said indoor heat exchanger which senses the temperature of the air stream blown over said indoor heat exchanger in the warming operation mode, and control means connected to said first and second temperature sensors to stop operation of said burner in the warming operation when the refrigerant temperature sensed by said first temperature sensor has exceeded a predetermined value not higher than the deterioration temperature of said refrigerant as well as a refrigerating machine oil, and also to regulate the rate of flow of the air from said blower in dependence on the air temperature sensed by said second temperature sensor.

19. A heat pump type airconditioner according to claim 18, wherein said control means comprises means for regulating the rate of flow of air from said blower so as to be small when the temperature of said air stream blown over said indoor heat exchanger is low, and to be large when it is high.

* * * * *